US005598671A

United States Patent [19]

Ting

[11] Patent Number: 5,598,671

[45] Date of Patent: Feb. 4, 1997

[54] EXTERNALLY DRAINED WALL JOINT

[76] Inventor: Raymond M. L. Ting, 318 Holiday Dr., Pittsburgh, Pa. 15237

[21] Appl. No.: 387,043

[22] Filed: Feb. 9, 1995

[51] Int. Cl.[6] ..... E04H 1/00

[52] U.S. Cl. ..... 52/235; 52/234; 52/302.1; 52/302.3

[58] Field of Search ..... 52/235, 302.1, 52/302.3, 573.1, 582.1, 234

[56] References Cited

U.S. PATENT DOCUMENTS 4,607,471 8/1986 Olsen ..... 52/509
4,685,263 8/1987 Ting ..... 52/235
4,840,004 6/1989 Ting ..... 52/235
4,866,896 9/1989 Schreiner et al. ..... 52/235

*Primary Examiner*—Carl D. Friedman
*Assistant Examiner*—David J. Jersen
*Attorney, Agent, or Firm*—Michael J. Kline; Noland J. Cheung; Carol I. Bordas

[57] ABSTRACT

This invention relates to exterior building wall systems utilizing multiple wall panels forming horizontal and vertical wall joints. Each individual wall panel consists of an essentially flat exterior facing member and four perimeter members structurally connected to the facing member. The design of the perimeter members and the combination of differential pressure seals and pressure equalized seals enable the system to prevent water from infiltrating into the building. In addition, this invention is easily disassembled and saves much time and expense.

18 Claims, 5 Drawing Sheets

EXTERNALLY DRAINED WALL JOINT

FIELD OF THE INVENTION

This invention relates to exterior building wall systems utilizing multiple wall panels forming horizontal and vertical wall joints. Each individual wall panel consists of an essentially flat exterior facing member and four perimeter members structurally connected to the facing member. The facing member can be made of material such as glass, natural or artificial stone, composite honeycomb, composite foam or metal. More specifically, this invention utilizes differential pressure seals and pressure equalized seals to prevent water from infiltrating the structure. In addition, this invention allows one panel to be disassembled without having to disassemble an adjacent panel. Furthermore, the panels of this invention are easily disassembled and saves much time and expense.

DESCRIPTION OF THE PRIOR ART

It is generally known that there is a substantial air pressure differential between the exterior and the interior of most modern buildings. The pressure differential always exists on the windward wall due to the wind forces and is sometimes magnified by the suction type air exchange system of the building.

In the prior art wall joint designs, the wall joint seals are located on or near the surface of the exterior wall. These sealant locations are subjected to exterior running water. As a result, the exterior running water will infiltrate through defects such as pin holes or cracks existing in the sealant caused by the effects of differential pressure.

Therefore, the quality of the sealant line must be perfect to prevent water infiltration. Such perfection, however, is almost impossible to achieve. A significant problem in achieving the perfect seal is the variance in field workmanship. Even, however, if a perfect seal were to exist, the perfection would only be short-lived, at least until environmental effects, such as wind, sunlight, ultraviolet radiation and thermal loads, degrade the seal.

The prior art designs, recognizing the difficulty in achieving the perfect seal, utilized a concept of "controlled leakage" in designing a solution. These systems allow water leakage, but control the leakage so that no interior water damage will occur.

The first feature of this type of design is to use interior perimeter aluminum members structurally connected to and sealed to the facing panel in the shop to form interlocking tongue-and-groove horizontal and vertical panel side joints. The tongue-and-groove joints are hidden behind but close to the facing panel and are sealed with non-bonding gasket material to allow free thermal movements of the panel surface without causing sealant stresses. The non-bonding contacting surface of the gasket, however, represents a continuous hairline crack which will allow water infiltration through the sealant line under positive differential pressure. Therefore, a second design feature is required to control water leakage through the gasket line.

The second feature creates a horizontal gutter (known as an internal gutter) behind the gasket line within the depth of the perimeter aluminum extrusion to collect the water leakage through the gasket line. Drainage holes, located at the bottom of the gutter, are provided to drain the water to the outside after the differential pressure.

In addition, it is required to splice and to seal the horizontal internal gutter across the vertical wall joint, to seal off the holes at the four corner intersections, and to seal the area between the horizontal and vertical gasket lines (known as a marriage seal) in the field to complete the system. Again, these three field sealing operations must rely on careful workmanship in the field.

Other drawbacks of the internal gutter system are as follows:

1) the drainage holes link the interior air and the exterior air, thus, the holes are the source of air leakage which will reduce the thermal efficiency in the building;

2) if the drainage holes are subjected to the exterior running water, the water will be sucked inwardly through the drainage holes due to differential pressure;

3) since the drainage holes act as a link between the exterior and interior air, the water head inside the internal gutter must be increased to overcome the differential pressure before outward drainage can take place;

a) first, the gutter leg height must be larger than the expected water head to prevent overflow;

b) second, the butt joint of the internal gutter is more vulnerable to uncontrolled leakage due to the water head effect;

c) third, sustained differential pressure requires the water inside the internal gutter to be dried out by evaporation resulting in a high humidity. Therefore, a vapor barrier is normally used to protect the insulation installed behind the internal gutter system which results in additional cost;

4) since the internal gutter is open on the interior side, the drainage holes are vulnerable to clogging due to the deposit of foreign materials during the construction of the interior. For example, the interior fireproof spraying is often executed after the enclosure of the exterior wall;

5) the size of the drainage hole must be substantial for effective drainage to account for the effect of the differential pressure. Thus, the larger the hole, the better the drainage function. In contrast, the smaller the drainage hole, the better the thermal efficiency. As a result, the internal gutter system created the above two contradicting design objectives;

6) when the exterior air is being sucked through the drainage holes and then through the water inside the internal gutter, the effect is created, like boiling water, in which water droplets jump out of the internal gutter system. Such an effect is often uncontrollable and is prevented by utilizing either a baffle block or a shielding plate at the location of every drainage hole; and 7) the delay in draining can cause water stains on the panels.

My prior invention, Ting (U.S. Pat. No. 4,840,004), utilizes an interior perimeter frame to support the facing panel and to create a water drainage system within a pressure equalized wall cavity. The creation of the cavity eliminates the dependency on perfect field workmanship for water tight performance. The prior art, however, still requires perfect shop workmanship in applying the sealant along the perimeter of the exterior facing member.

SUMMARY OF THE INVENTION

The solution to the water leakage problem requires elimination of the dependency on perfect field and shop workmanship and the durability of sealant material. The objective of this invention is to provide a wall joint design which will change the controlled leakage problem to a no leakage condition. As a result, all of the drawbacks of the prior art designs will be eliminated.

In order to explain the working principles of this invention, the following terminologies are defined:

(1) Differential Pressure Seal ("D. P. Seal"): A sealant line between two air spaces having a significant differential air pressure. For the present invention, the sealant lines bordering the interior air space are considered D. P. Seals;

(2) Moving Joint: A joint between two wall components that is subjected to a significant relative movement due to thermal and/or wind loads;

(3) Non-moving Joint: A joint between two wall components that is subjected to an immaterial relative movement due to thermal and/or wind loads;

(4) Rain Screen: A device in front of a wall cavity to provide a shield to prevent rain water from dropping or splashing into the wall cavity;

(5) Pressure Equalized Cavity ("P. E. Cavity"): A wall cavity space that allows the exterior air to flow in freely such that the air pressure within the wall cavity can approach the exterior air pressure in a short period of time;

(6) Pressure Equalized Seal ("P. E. Seal"): A sealant line placed between a pressure equalized wall cavity and the exterior air.

Generally, the combination of the following three elements cause water infiltration: 1) water running over the sealant line, 2) hairline cracks or pin holes in the exposed sealant line, and 3) differential air pressure forcing the water to infiltrate through the cracks or holes. The water infiltration problem can be solved if one or more and preferably all, of the above elements can be eliminated.

In the above arrangements, no water will reach the differential seals of the wall joints. As a result, any imperfection in these seals will not result in water leakage.

The objective of the present invention is accomplished by preventing the water from reaching the D. P. Seals using a concealed member located away from the water path. In addition, a member with a P. E. Seal within the water path is utilized such that water will not infiltrate through the P. E. Seal despite imperfections. Another objective of the present invention is that each individual panel can be replaced without effecting the adjacent panels. The design functions of the present invention will become apparent in the explanations of the preferred embodiments.

DETAILED DESCRIPTION OF THE INVENTION

Figure 1:
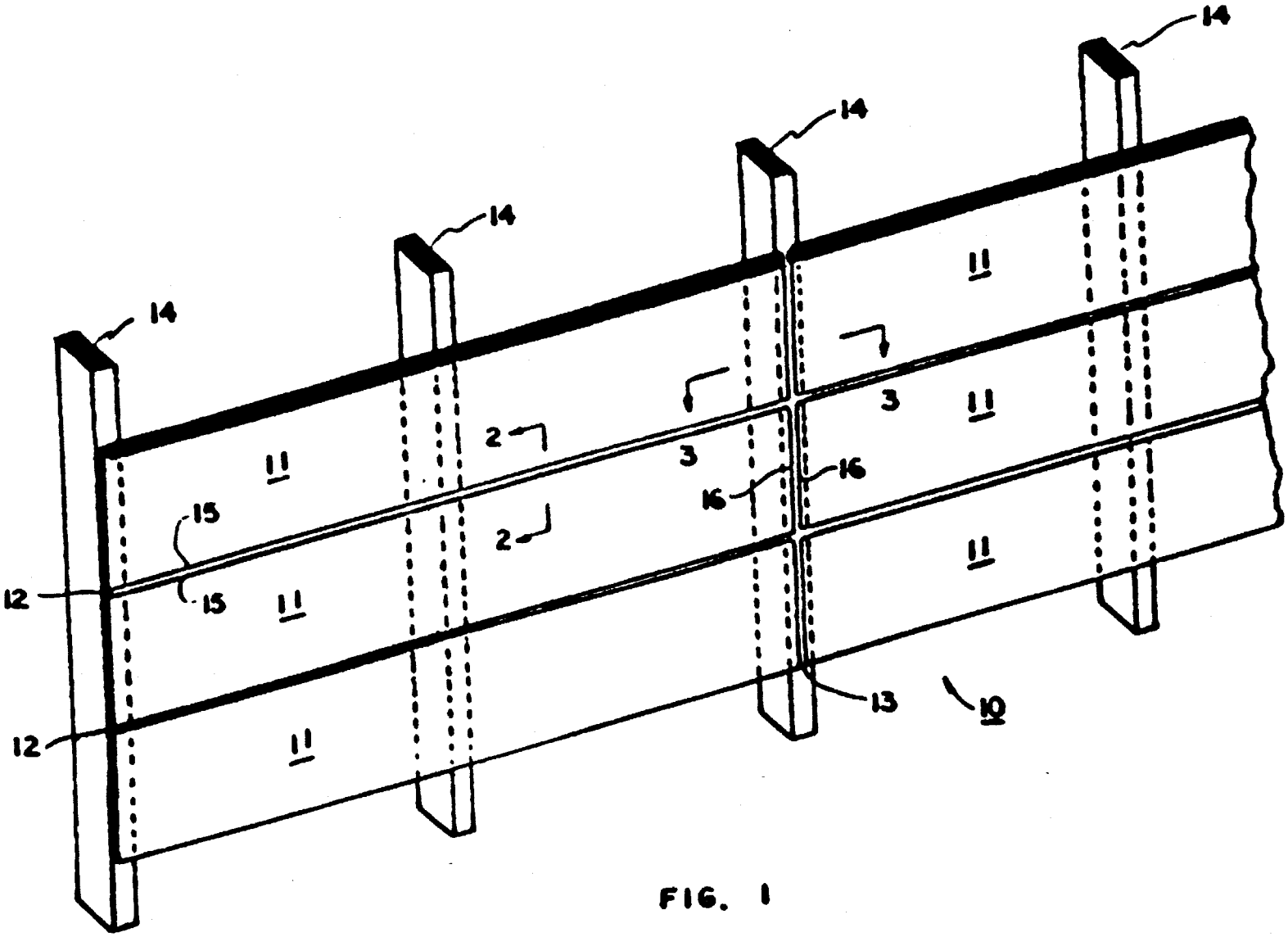
FIG. 1 is an isometric view illustrating a portion of the exterior wall system of the invention.

FIG. 1 illustrates an exterior wall structure 10, generally consisting of multiple wall panels 11 joined together along the horizontal edges 15 of the panel 11 to form horizontal wall joints 12 and along the vertical edges 16 of the panel 11 to form vertical wall joints 13. The wall panels are securely fastened to spaced apart wall supporting members 14, which are fastened to the building perimeter frame or masonry walls, not shown.

Figure 2:
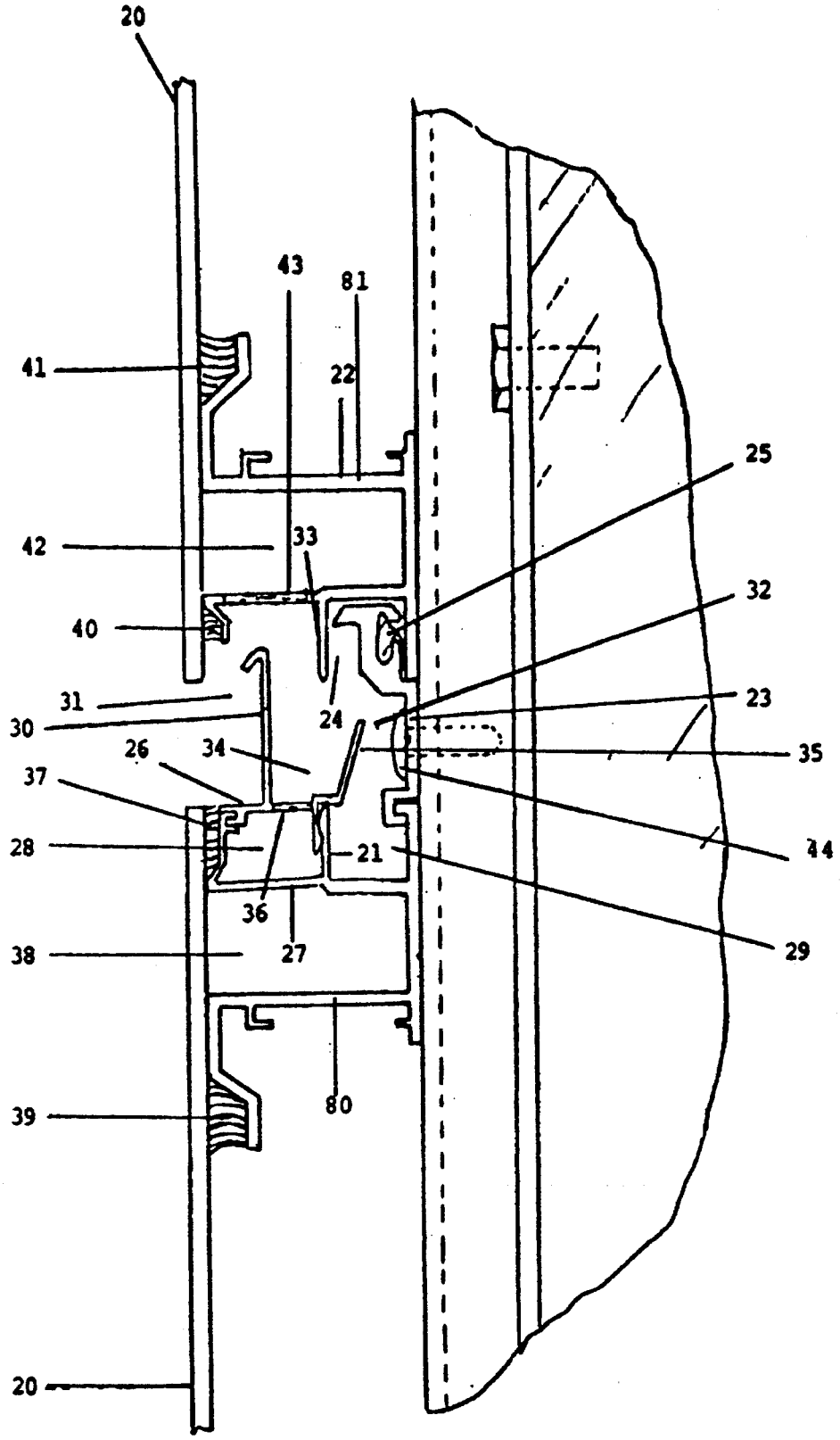
FIG. 2 is a typical fragmentary cross-sectional view taken along line 2—2 of FIG. 1 showing the horizontal wall joint of the invention in which an exterior facing plate is used.

FIG. 2 shows a fragmentary cross-section of the horizontal wall joint 12 taken along line 2—2 of FIG. 1. Each wall panel has an exterior plate 20, a top perimeter member 21, a bottom perimeter member 22, and two side perimeter members 50, shown in FIG. 3.

The top perimeter member 21 has a male horizontal joint spline member 23 located near the supporting member 14 to cause the structural engagement with the female joint 24 of the bottom perimeter member 22 of the panel immediately located above the top perimeter member 21. A seal 25 is provided between the male horizontal joint spline member 23 and the female joint 24 to seal the female joint to the male horizontal joint spline member 23. A fastening means 26, such as a nail, clip, stud, screw, and etc., is provided to fasten the top perimeter member 21 to the structure 10. Since the bottom perimeter member 22 is interlocked to the top perimeter member 21, the top perimeter member 21 is also secured to the wall structure 10.

The top perimeter member 21 also comprises a gutter member 26 fastened to a lower member 27 to form a hidden horizontal drainage tunnel 28 and a lower horizontal cavity 29. The gutter member 26 can either be integrally molded to the lower member 27 or can be fastened by a "snap-on" means, a nail, clip, stud, screw, etc. The gutter member 26 comprises an upwardly protruding rain screen member 30 to separate the horizontal wall cavity into an outer horizontal cavity 31 and an inner horizontal cavity 32. In addition, an upwardly protruding rear gutter leg 35, forms a gutter cavity 34 between the rain screen member 30 and the rear gutter leg 35. Drainage holes 36, which are located on the section of the gutter member 26 between the rain screen member 30 and the rear gutter leg 35, are provided to allow the drainage of water from the gutter cavity 34 into the hidden horizontal drainage tunnel 28.

Wind driven water will be repelled by the rain screen member 30. Any water spilled over the rain screen member 30, however, will be guided by a inner screen leg 33, which protrudes downwards from the bottom perimeter member 22 into the hidden horizontal drainage tunnel 28 via the gutter cavity 34 and drainage holes 36. Exterior air can freely flow into the outer horizontal cavity 31 into inner horizontal cavity 32, into gutter cavity 34, through drainage holes 36, and into the hidden horizontal drainage tunnel 28. As a result, the outer horizontal cavity 31, inner horizontal cavity 32, gutter cavity 34, and the hidden horizontal drainage tunnel 28 are P. E. cavities. Since both the gutter cavity 34 and hidden horizontal drainage tunnel 28 are pressure equalized, the drainage of water from the gutter cavity 34 to the hidden horizontal drainage tunnel 28 will be instantaneous and therefore, no water buildup will be present in the gutter cavity 34. It becomes apparent that the water will not accumulate and rise up to a level to reach the differential seal 25. Therefore, any imperfection in seal 25 will not cause water infiltration into the interior of the building.

The upper side of exterior plate 20 is structurally connected to the top perimeter member 21 by a seal 37 to form a top perimeter cavity 38. In addition, a second seal 39, which is located near the bottom of top perimeter member 21 is also used to structurally connect the upper side of exterior plate 20 to the top perimeter member 21.

The bottom side of exterior plate 20 is structurally connected to the bottom perimeter member by a seal 40 and a second seal 41 to form a bottom perimeter cavity 42. Pressure equalization holes 43, located on the bottom perimeter member, equalize the pressure in the bottom perimeter cavity 42. Since the top perimeter cavity 38 is connected to the bottom perimeter cavity 42 by a side cavity 55, shown in FIG. 3, the top perimeter cavity 38 is also a P. E. cavity. As a result, seals 37 and 40 are P. E. Seals. Therefore, this design can sustain a high degree of sealing imperfection without permitting water infiltration from the outside and through seal 37 or seal 40.

Seals 39 and 41 are D. P. Seals. These seals 39 and 41, however, are not subjected to the water path described above. Thus, despite possible imperfections in these D. P. Seals 39 and 41, there will be no water infiltration through the D. P. Seals 39 and 41, since the exterior water is prevented from reaching them.

If the male horizontal joint spline 23 or rain screen member 30 is not integral to lower member 27, each individual exterior plate 20 can be removed or replaced without removing the adjacent panel 20. To replace an individual panel, the rain screen member 30 is unsnapped by lifting the rain screen member upwards. The rain screen member 30 is then removed from the cavity thus, exposing the screw 44 for easy removal. Once the screw 44 is removed, the male horizontal joint spline member 23 can then be removed. Finally, the individual panel can then be removed. To reinstall the panel, the aforementioned process is performed in reverse.

Figure 3:
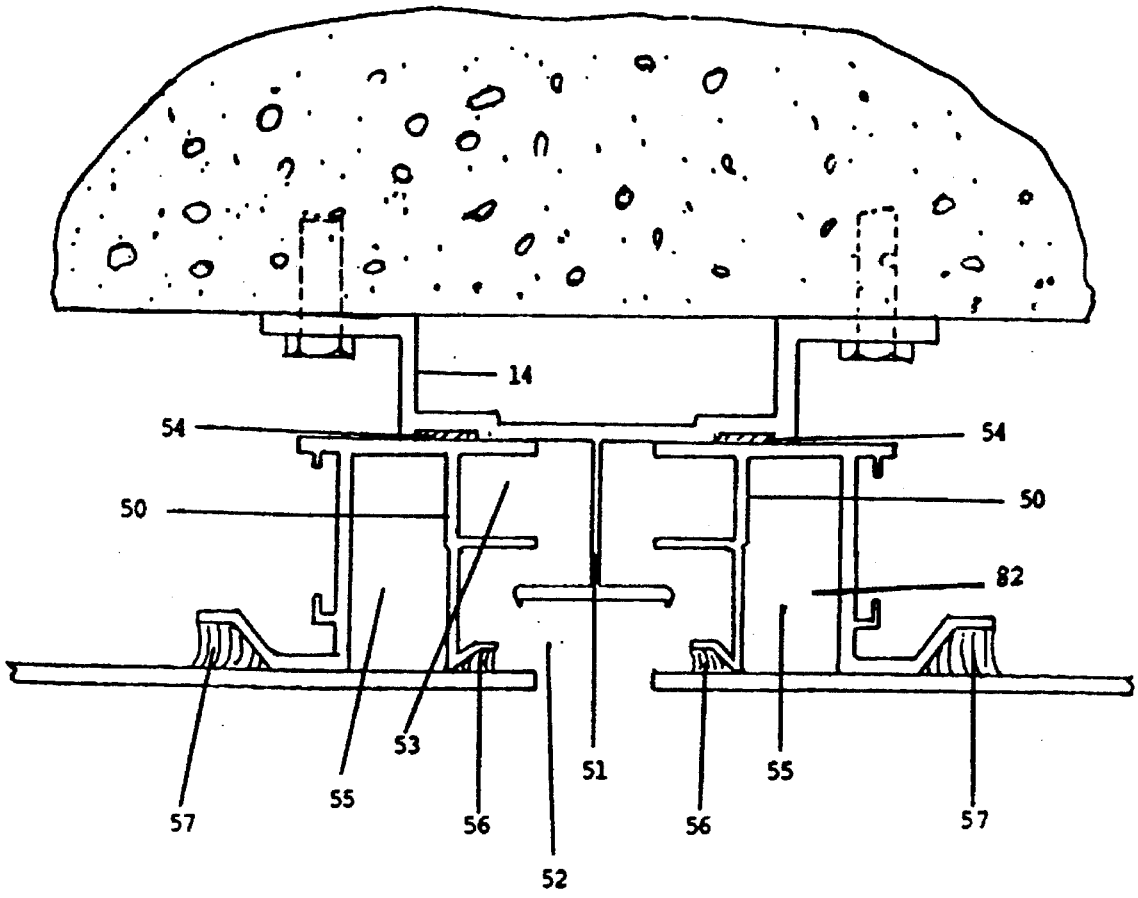
FIG. 3 is a typical fragmentary cross-sectional view taken along line 3—3 of FIG. 1 showing the vertical wall joint of the invention in which an exterior facing plate is used.

FIG. 3 shows a typical fragmentary cross section of the vertical wall joint 13 taken along line 3—3 of FIG. 1. The side perimeter members 50 are extended to the vicinity of the supporting member 14. Continuous vertical wall joint seals 54 are provided between supporting member 14 and the side perimeter members 50 to seal the side perimeter members 50 to the supporting member 14.

A vertical joint rain screen member 51 is installed inside the vertical wall cavity to separate the vertical wall cavity into an outer vertical cavity 52 and an inner vertical cavity 53. The vertical joint rain screen member 51 may be integrally formed with the supporting member 14 or may be fastened to either one or both side perimeter members 50 by a "snap-on means," nail clip stud screw etc. It is also desirable to position the vertical joint rain screen member 51 behind the rain screen member 30 of the horizontal wall joint 12 so that the vertical joint rain screen member 51 can be installed without interference through multiple panel heights.

Each side of the exterior plate 20 is structurally connected to each side perimeter member by the use of two seals 56, 57 to form a side cavity 55. Since the side cavities 55 are also pressure equalized, seals 56 are P. E. Seals, therefore, this design can sustain a high degree of sealing imperfection without permitting water infiltration from the outside and through seal 56.

Seals 57 are D. P. Seals. These seals 57, however, are not subjected to the water path described above. Thus, despite possible imperfection in these D. P. Seals 57, there will be no water infiltration through the D. P. Seals 57, since the exterior water is prevented from reaching them.

As shown in FIG. 3, the majority of the exterior water will be kept in front of the vertical joint rain screen member 51 within the outer vertical cavity 52. A small amount of water, however, may be forced around the vertical joint rain screen member 51 into the inner vertical cavity 53 by wind forces. Water that enters the inner vertical cavity 53 will drain downwardly to the bottom end of the vertical wall joint 13 for eventual drainage to the outside. As a result, no possibility exists for the water to reach the continuous vertical wall joint seals, which are D. P. Seals 54. Therefore, any imperfection in D. P. Seals 54, will not cause water leakage.

Figure 4:
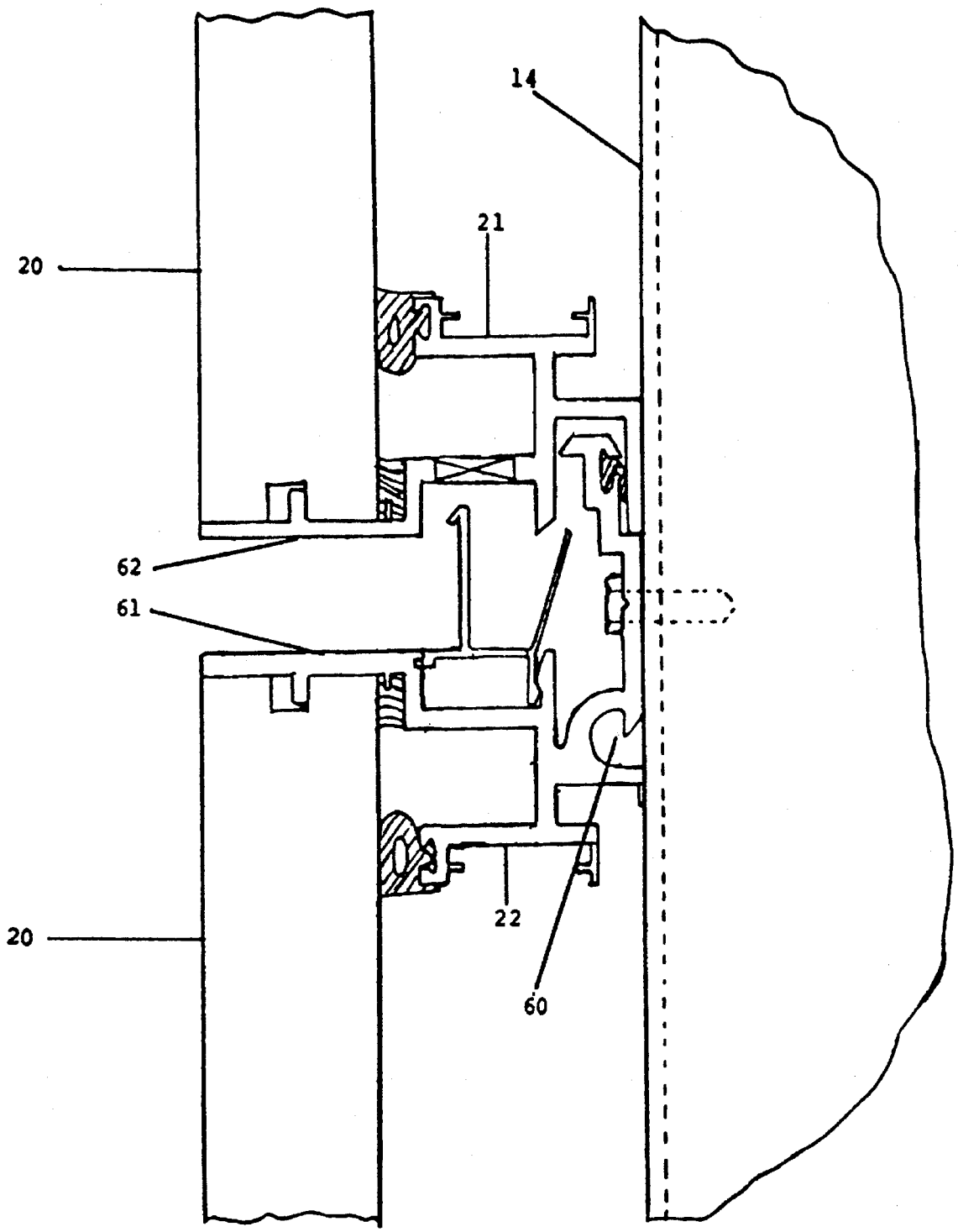
FIG. 4 is a variation of FIG. 2 wherein an exterior facing stone or precasted concrete panel is used.

FIG. 4 is a variation of FIG. 2 in which the exterior plate 20 is either a natural stone or a precasted concrete panel. As shown in FIG. 4, an extrusion clip cavity 60 can be provided for a side clip (not shown) fastening method to structurally connect the bottom and top perimeter member 22 and 21 to the exterior supporting member 14. Other fastening means, however may be used, such as screws, nails, welded studs, and etc. In addition, the exterior plate 20 is structurally connected to the top and bottom perimeter members 21 and 22 using an upper and lower supporting member 61 and 62. All of the other functional designs are the same as explained in FIG. 2.

Figure 5:
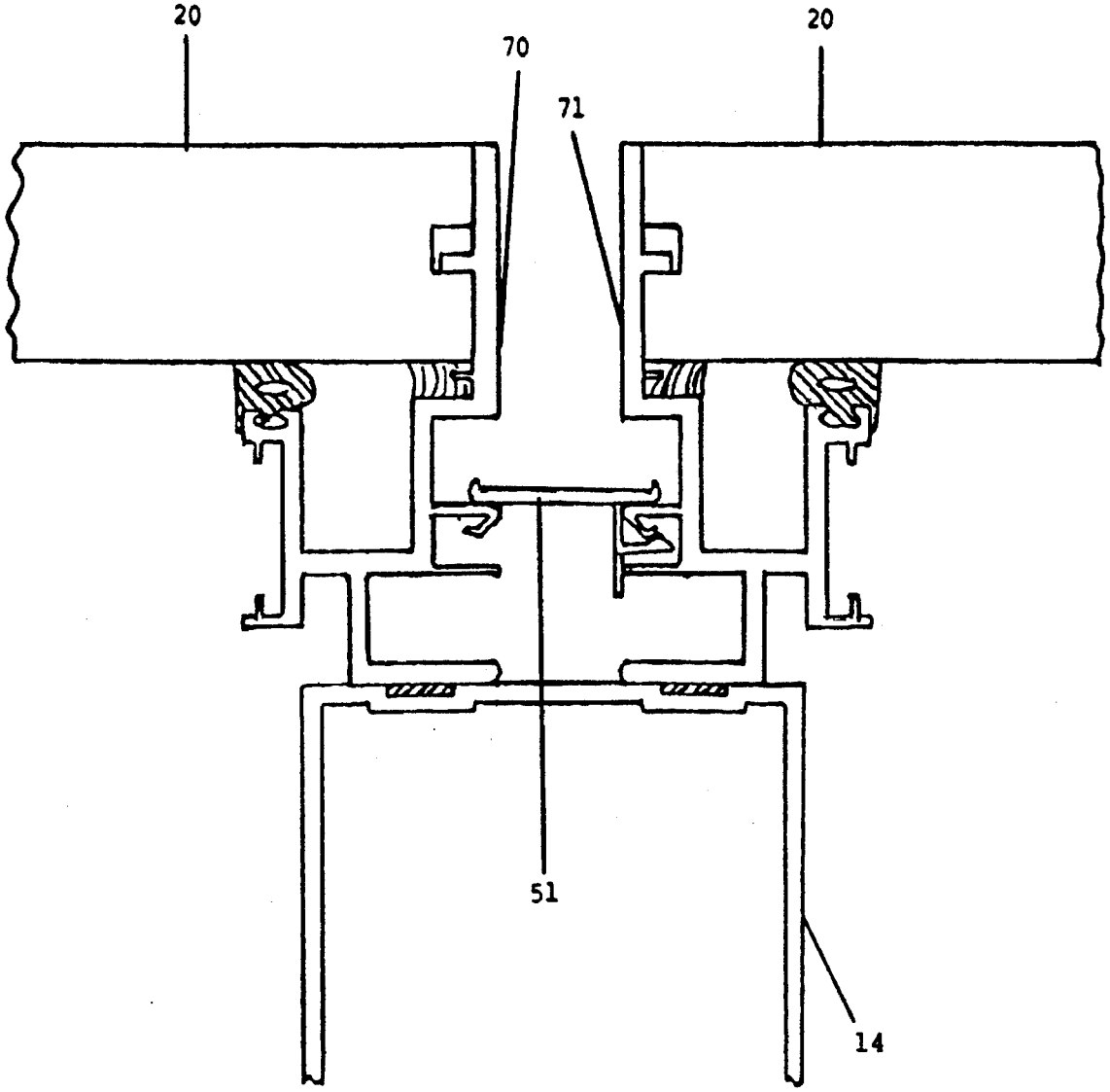
FIG. 5 is a variation of FIG. 3 wherein an exterior facing stone or precasted concrete panel is used.

FIG. 5 is a variation of FIG. 3 in which the exterior plate 20 is either natural stone or a precasted concrete panel. The exterior plate 20 is structurally connected to the side perimeter members using a left and right supporting member 70 and 71. As shown in FIG. 5, the vertical rain screen member 51 may be fastened to the side perimeter member through a snap-on means. The vertical rain screen member 51, as shown in FIG. 3, may also be integrally connected with the supporting member 14. All the other functional designs are the same as explained in FIG. 3.

Reviewing FIG. 2 and FIG. 3 concurrently, it is preferred to maintain the same profile for the inner surface 80 of the top perimeter member 21, the inner surface 81 of the bottom perimeter member 22, and the inner surface 82 of the side perimeter member so that all corners can be miter-matched for easy sealing. As a result, the assembled wall panel 11 consists of an exterior plate 20 and four miter matched perimeter members resembling a framed picture.

Seals 37, 40, 56, 39, 41, and 57 are shop formed non-moving joint seals. Seals 25 and 54 are field-formed moving joint seals.

The material for the top perimeter member 21, bottom perimeter member 22, and side perimeter members 50 can be made of materials such as combinations of extruded aluminum, extruded PVC, or other suitable extrudable materials.

The present invention can also be adapted for various shapes or forms of wall panels 11.

While I have illustrated and described several embodiments of my invention, it will be understood that these are by way of illustration only and that various changes and modifications may be contemplated in my invention and within the scope of the following claims.

I claim:

1. A system for sealing an opening in a structure including a wall panel assembly formed from individual wall panels from infiltration from the exterior to interior of said structure, each said wall panel having a top and bottom horizontal edge and a pair of vertical side edges, said wall panels being joined along said horizontal edges to form a horizontal wall joint and along said vertical edges to form a vertical wall joint, said wall panel assembly comprising an exterior plate and four perimeter members, said perimeter members comprising a top perimeter member, a bottom perimeter member, and two side perimeter members; pressure equalized seal between said bottom perimeter member, said outer horizontal cavity and said exterior plate and a differential pressure seal between said bottom perimeter member and said exterior plate; a pressure equalized seal between said top perimeter member, said outer horizontal cavity and said exterior plate and a differential pressure seal between said top perimeter member and said exterior plate; for connecting said top and bottom perimeter member to said exterior plate to form a pressure equalized bottom and top perimeter cavity; a means for connecting said side perimeter members to said exterior plate to form two side cavities; a means for connecting said top perimeter member to said supporting member; a means for connecting said side perimeter member to said supporting member; a horizontal wall cavity being formed between each said horizontal wall joint between said top perimeter member and said bottom perimeter member across said horizontal wall joint, said bottom perimeter member including at least one pressure equalization hole between said bottom perimeter cavity and said horizontal wall cavity; a vertical wall cavity being formed at each said vertical wall joint between said side perimeter members across said vertical wall joint; said top perimeter member including a rain screen member to separate said horizontal wall cavity into an outer horizontal wall cavity and an inner horizontal wall cavity, said top perimeter member further comprising a rear gutter leg behind said rain screen member and at least one drainage hole between said rain screen member and said rear gutter leg; said top perimeter member including a male horizontal joint spline member behind said inner horizontal cavity; said bottom perimeter member of an adjacent exterior plate including a horizontal female joint to cause engagement with said male horizontal joint spline member; a vertical rain screen member installed within said vertical wall cavity to separate said vertical wall cavity into an outer vertical cavity and an inner vertical cavity; and said side cavity connecting said top perimeter member and said bottom perimeter member.

2. A system for sealing an opening in a structure according to claim 1, wherein said perimeter member is an extrusion.

3. A system for sealing an opening in a structure according to claim 2, wherein said extrusion is an aluminum extrusion.

4. A system for sealing an opening in a structure according to claim 2, wherein said extrusion is a PVC extrusion.

5. A system for sealing an opening in a structure according to claim 1, wherein said means for connecting said side perimeter members to said exterior plate comprises a P. E. Seal between said side perimeter member, said outer vertical cavity, and said exterior plate and a differential pressure seal between said side perimeter member and said exterior plate.

6. A system for sealing an opening in a structure according to claim 1, wherein said means for connecting said top perimeter member to said supporting member is a screw.

7. A system for sealing an opening in a structure according to claim 1, wherein said means for connecting said side perimeter member to said supporting member is a seal.

8. A system for sealing an opening in a structure from water infiltration from the exterior to interior of said structure, said system including a wall panel assembly formed from individual wall panels, wherein each said wall panel comprises a top and bottom horizontal edge and a pair of vertical side edges, said wall panels being joined along said horizontal edges to form a horizontal wall joint and along said vertical edges to form a vertical wall joint, said wall panel assembly comprising:

a) an exterior plate and i) a top perimeter member;

ii) a bottom perimeter member; and iii) two side perimeter members;

b) at least one seal for connecting each said top and bottom perimeter member to said exterior plate to form a top and bottom pressure equalized perimeter cavity; said top and bottom pressure equalized perimeter cavities, said exterior plate, said structure and said side perimeter members are connected to form an interior air space; said top perimeter member also comprising a gutter member and a lower member, a means for fastening said gutter member to said lower member to form a horizontal drainage tunnel;

c) means for connecting each said side perimeter member to said exterior plate to form two side cavities;

d) means for securing said top perimeter member to said structure; and e) said bottom perimeter member including at least one pressure equalization hole.

9. A system for sealing an opening in a structure according to claim 8, wherein a horizontal wall cavity is formed at each said horizontal wall joint between said top perimeter member and said bottom perimeter member of an adjacent exterior plate across said horizontal wall joint and a vertical wall cavity is formed at each said vertical wall joint between said side perimeter member and a side perimeter of an adjacent exterior plate across said vertical wall joint.

10. A system for sealing an opening in a structure according to claim 9, wherein said top perimeter member comprises a gutter member and a lower member, a means for fastening said gutter member to said lower member to form a horizontal drainage tunnel and a lower horizontal cavity.

11. A system for sealing an opening in a structure according to claim 10, wherein said means for fastening said gutter member to said lower member comprises snap fit means for fastening said gutter member to said lower member.

12. A system for sealing an opening in a structure according to claim 9, wherein said bottom perimeter member includes at least one pressure equalization opening between said bottom perimeter cavity and said horizontal wall cavity.

13. A system for sealing an opening in a structure according to claim 10, wherein said gutter member comprises a rain screen member to separate said horizontal wall cavity into an outer horizontal wall cavity and an inner horizontal wall cavity, said gutter member further comprising a rear gutter leg behind said rain screen member and at least one drainage hole between said rain screen member and said rear gutter leg.

14. A system for sealing an opening in a structure according to claim 13, wherein said top perimeter member comprises a male horizontal joint spline member behind said inner horizontal wall cavity, said bottom perimeter member of an adjacent exterior plate having a horizontal female joint to cause engagement with said male horizontal joint spline member.

15. A system for sealing an opening in a structure according to claim 13, wherein said top perimeter cavity and said bottom perimeter cavity is connected by each said side cavity.

16. A system for sealing an opening in a structure according to claim 8, wherein said means for connecting each said side perimeter member to said exterior plate to form two side cavities is at least one seal.

17. A system for sealing an opening in a structure according to claim 8, wherein said means for connecting said side perimeter member to said exterior plate to form two side cavities is a left and right supporting member.

18. A system for sealing an opening in a structure according to claim 8, wherein said means for connecting said top perimeter member to said structure is selected from the group consisting of a nail, clip, stud and screw.

* * * * *